US009216848B1

(12) United States Patent
Trinko et al.

(10) Patent No.: US 9,216,848 B1
(45) Date of Patent: Dec. 22, 2015

(54) TWIST TIE AND METHOD OF DISPENSING SAME

(75) Inventors: Dominic Trinko, LaCrosse, WI (US); Thomas Trinko, Menasha, WI (US)

(73) Assignee: The Trinko Group, LLC, Menasha, WI (US)

( * ) Notice: Subject to any disclaimer, the term of this patent is extended or adjusted under 35 U.S.C. 154(b) by 442 days.

(21) Appl. No.: 12/971,231

(22) Filed: Dec. 17, 2010

Related U.S. Application Data

(60) Provisional application No. 61/288,058, filed on Dec. 18, 2009.

(51) Int. Cl.
*B65H 3/58* (2006.01)
*B65D 63/00* (2006.01)

(52) U.S. Cl.
CPC ..... *B65D 63/00* (2013.01)

(58) Field of Classification Search
CPC ..... B65D 83/0811; B65D 63/00
USPC ..... 245/3; 221/26; 225/106
See application file for complete search history.

(56) References Cited

U.S. PATENT DOCUMENTS 1,479,431 A * 1/1924 Gerrard et al. ..... 24/27
2,973,597 A * 3/1961 Powell ..... 40/665
3,674,176 A * 7/1972 Sagi ..... 221/135
3,702,672 A * 11/1972 Becht ..... 225/106
3,757,626 A * 9/1973 Kulp ..... 83/542
4,539,237 A * 9/1985 Clayton ..... 428/41.7
4,543,958 A * 10/1985 Cartmell ..... 600/391
4,883,197 A * 11/1989 Sanchez et al. ..... 221/26
4,948,202 A * 8/1990 Helseth ..... 312/35
5,213,400 A * 5/1993 Helseth ..... 312/35
5,961,434 A * 10/1999 Helseth ..... 493/352
5,975,299 A * 11/1999 Weder et al. ..... 206/423
6,217,500 B1 * 4/2001 Helseth et al. ..... 493/352
6,514,585 B1 * 2/2003 Pearson et al. ..... 428/40.1
6,660,202 B2 * 12/2003 Shepard et al. ..... 264/167
7,452,165 B2 * 11/2008 Tyler ..... 405/302.6
7,856,754 B2 * 12/2010 Long ..... 47/47
8,052,009 B2 * 11/2011 Blum et al. ..... 221/73
2003/0150087 A1 * 8/2003 Dieterich ..... 24/306
2004/0026284 A1 * 2/2004 Cote ..... 206/397
2004/0083871 A1 * 5/2004 Mosher ..... 83/663
2005/0035240 A1 * 2/2005 Weck et al. ..... 242/588.4
2008/0313957 A1 * 12/2008 Long ..... 47/44

* cited by examiner

*Primary Examiner* — Michael K Collins
(74) *Attorney, Agent, or Firm* — Boyle Fredrickson, S.C.

(57) ABSTRACT

A twist tie and dispensing system provides for the dispensing of single twist ties attached together end-to-end in a semi continuous ribbon having spaced separation points that permit separation of individual twist ties at a predetermined tension. Twist ties may be dispensed through an aperture that engages with obstructions placed periodically on the ribbon to cause pulling of the twist tie through the aperture to impart the necessary separating tension when the obstruction is reached so that one twist tie at a time may be dispensed.

12 Claims, 2 Drawing Sheets

TWIST TIE AND METHOD OF DISPENSING SAME

CROSS REFERENCE TO RELATED APPLICATION

This application claims the benefit of U.S. patent application 61/288,058 filed Dec. 18, 2009 and hereby incorporated by reference.

BACKGROUND OF THE INVENTION

The present invention relates generally to a twist tie fastener. More particularly, the present invention relates to twist ties that provide improved dispensing and storage.

Twist ties are used for various fastening and closing purposes by wrapping the twist tie around material to be bundled and twisting the ends of the twist tie together.

A common form of twist tie provides a ductile wire enclosed in a paper or plastic ribbon extending along the wire. The ribbon increases the surface area of the wire making it easier to handle and less likely to pull through or cut the bundled material.

Such twist ties have advantageous properties that have led to widespread use in a variety of applications. First, wire twist ties are readily applied using either manual or high-speed mechanical operations. Second, multiple fastening and unfastening cycles do not significantly affect the fastening capability of the wire twist ties. Third, twist ties are functional over a wide range of temperatures without a significant reduction in fastening capability.

There are many food-packaging applications where twist ties play an important role because twist ties enable consumers to quickly and intuitively access and reseal a product numerous times. In one important application, twist ties are used to seal plastic produce bags as may be provided at a grocery store. To seal the bag, material of the bag adjacent to the open end is gathered and the twist tie is wrapped around the gathered material until end portions of the twist tie are adjacent to each other. The end portions are then twisted relative to the remainder of the twist tie to fasten the twist tie onto the package.

When twist ties are used in a retail environment, for example for closure of produce bags at a grocery store, they may be provided to the consumer in a loose bundle, for example in a dish or cup. This can lead to waste when twist ties are spilled or multiple twist ties are inadvertently taken.

One alternative to this approach, commercially available under the trade name of Twist Ease, joins many twist ties at their ends along a spine, like matches in a matchbook. Each twist tie can be removed, one at a time, with a slight pull. The remaining ties are held in place so that only one is taken at a time reducing messes and spills. See, for example, U.S. Pat. No. 6,217,500.

This latter approach entails the cost of assembling the twist ties together at their ends with a releasable glue material and requires a special stand to properly support the spine against the force of removing each tie.

SUMMARY OF THE INVENTION

The present invention provides a semi-continuous reel or bundle of twist ties releasably attached end-to-end to be dispensed through an aperture. Slight deformations in the twist ties or normal friction between the aperture and the assembly of twist ties causes a separation of the ties as each tie is pulled through the aperture. Because only a single tie is presented at a time, the possibility of grabbing multiple ties is reduced. The aperture may be part of a box or similar container, holding the unused ties in a sanitary environment. The box may fit in a special stand or be used free standing on a table or the like, and may have advertising or other information printed thereon.

Specifically then, the present invention provides a twist tie assembly having a series of twist ties each comprising a ductile wire extending along a length and attached to a flexible strip also extending along the length and on either side of the wire by a distance, wherein the twist ties are releasably attached end-to-end to form a ribbon separable at junctions between ends of the twist ties by a predetermined tension applied across the junction by a user pulling on a twist tie.

It is thus a feature of at least one embodiment of the invention to provide a method of single-dispensing of twist ties by a consumer.

The twist ties may be releasably attached end-to-end by continuations of only portions of the flexible strip across the junctions.

It is thus a feature of at least one embodiment of the invention to provide twist ties that may be separated with very low forces, for example, with normal forces of dispensing.

The continuations of portions of the flexible strip may be portions at opposed edges of the ribbon perpendicular to the length.

It is thus a feature of at least one embodiment of the invention to provide maximum torsional resistance in the junction while preserving a low tensile breaking point. By displacing the connected portions of the flexible strip to outer edges of the ribbon, greater effective torsional resistances are obtained.

The wire may be partially or fully cut at the junctions.

It is thus a feature of at least one embodiment of the invention to provide twist ties that may be separated by hand without special equipment or cutters.

Each twist tie may further include an obstruction to catch on a slot sized to freely pass the twist ties along their length but for the obstruction.

It is thus a feature of at least one embodiment of the invention to provide a feature that promotes a severing of the twist ties upon dispensing and/or that stabilizes the next twist tie to be grasped by the user.

The obstruction may be a bend formed in the twist tie to provide a hump extending perpendicularly from the length of the twist tie.

It is thus a feature of at least one embodiment of the invention to provide an obstruction that maybe introduced into conventionally manufactured twist ties and/or that does not interfere with use of the twist tie.

The series of twist ties may be rolled in a coil to provide center dispensing.

It is thus a feature of at least one embodiment of the invention to provide a coiling architecture that provides minimal or substantially constant back tension.

These particular objects and advantages may apply to only some embodiments falling within the claims and thus do not define the scope of the invention.

DETAILED DESCRIPTION OF THE PREFERRED EMBODIMENT

Figure 1:
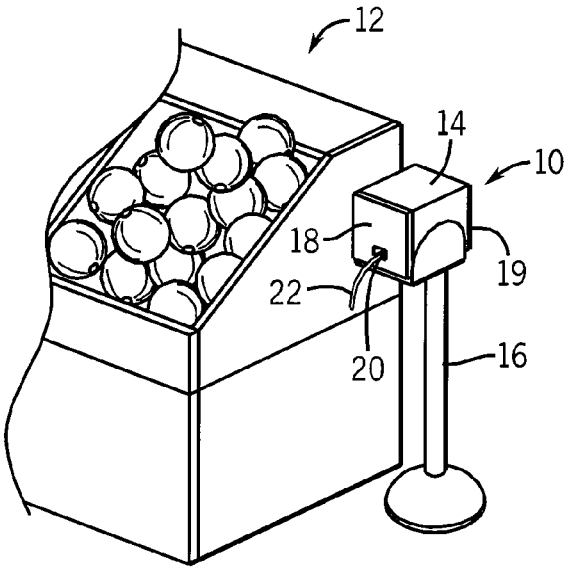
FIG. 1 is a perspective view of a dispensing system per the present invention in the environment of a grocery store showing a dispensing box for dispensing twist ties.

Referring now to FIG. 1, in one embodiment of the invention, a twist tie dispensing system 10 may be positioned adjacent to a point of use, for example a produce bin 12 in a grocery store.

The twist tie dispensing system 10 may provide for a twist tie container 14 supported by a stand 16 or the like to be at a convenient height for dispensing. The container 14 may, for example, be a reusable metal or clear plastic box or may be a disposable or reusable cardboard box placed in a retaining tray 19 or the like being part of the stand 16. A front face 18 of the container 14 may hold a dispensing aperture 20 through which a twist tie 22 may extend to be grasped by a user and removed for use in sealing a produce bag or the like.

Figure 2:
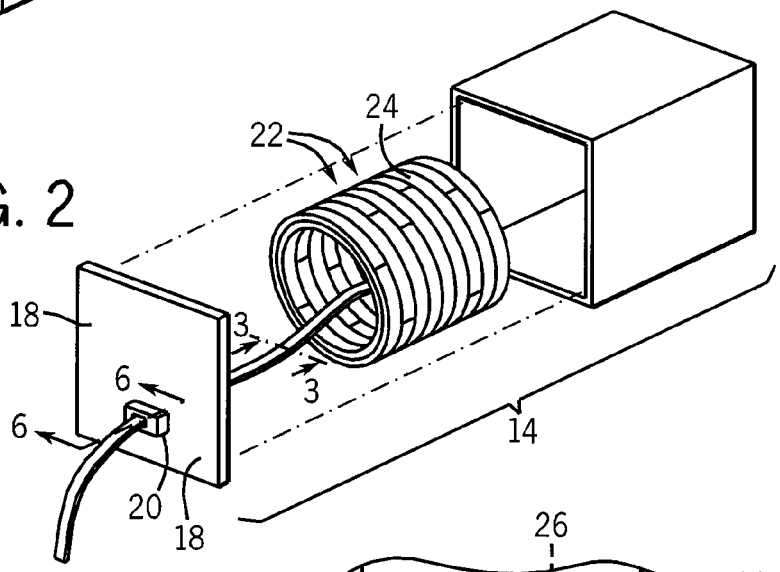
FIG. 2 is an exploded perspective view of the box of FIG. 1 showing a center-pull coil of twist ties as dispensed through an aperture in one box wall.

Referring to FIG. 2, the container 14 may hold a reel 24 of twist ties 22 joined in a semi continuous ribbon in a so-called "coreless" or center-pull coil allowing twist ties 22 to be pulled from the center of the reel 24 forward through the aperture 20 with minimal kinking. The aperture 20, for example, may be a molded thermoplastic molded material inserted into a face 18 of the container 14 as will be described below. Alternatively, but not shown, the twist ties 22 may be wound around a reel having a center axle on which the reel may turn to allow the twist ties 22 to be unwound along a tangent to the reel as the reel rotates about the axle.

Figure 3:
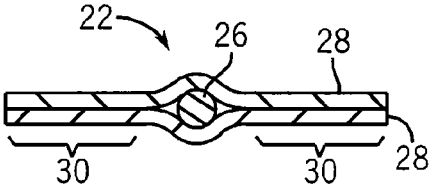
FIG. 3 is a cross-section taken along line 3-3 of FIG. 2 showing construction of the twist ties with a central wire sandwiched between two strips of flexible material.

Referring now to FIG. 3, each twist tie 22 may include a center metallic wire 26, for example, of ductile or "soft" iron or steel wire sandwiched between an upper and lower strip material 28 of paper or plastic. These strip materials 28 extend along a length of the wire 26 and perpendicularly on either side of the wire 26 to form wing portions 30 of predetermined dimension. The width of the strip materials 28, for example, may be approximately 3/16 of an inch. The upper and lower strip material 28 may be glued together to hold the wire 26 centered between their edges according to techniques well understood in the art.

Figure 4:
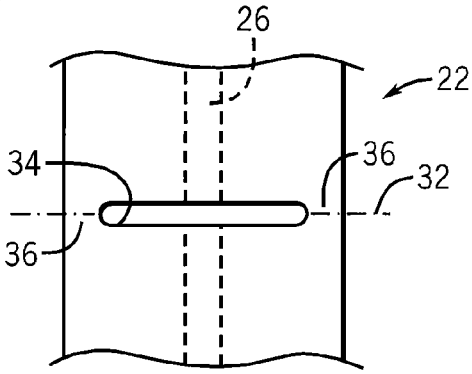
FIG. 4 is a top plan view of the twist tie of FIG. 3 showing a die cut severing the internal wire and a center portion of the flanking strips.

Referring now to FIG. 4, at periodic junctions 32 along the length of the twist ties 22, for example every 4 inches, the twist ties 22 may be cut by a slot 34 severing the internal wire 26 and cutting through a portion of the upper and lower strip material 28 on either side of the internal wire 26. The slot 34 may be such as to preserve uncut portions of the strip material 28 at edge regions 36 opposed across a width of the twist tie 22 retaining the twist ties 22 together across the junctions 32 against forces less than a predetermined separation force that would tear through these uncut portions of the edge regions 36.

Figure 5:
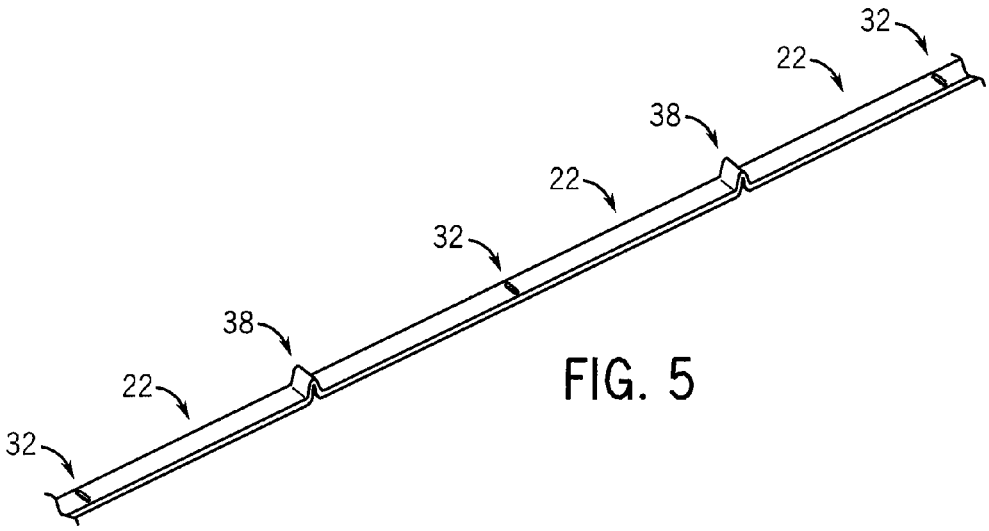
FIG. 5 is a perspective view of a length of interconnected twist ties showing positioning of obstructions along the length for providing controlled separation of the twist ties for single dispensing.

Referring now to FIG. 5, at points between the junctions 32, deformable obstructions 38 may be formed in the twist tie 22, for example humps formed by a sharp bend across the length of the twist tie 22 upward then downward again by an equal distance to provide an extension or embossment extending upward perpendicularly to the length of the twist tie 22. In one embodiment, the location of the obstructions 38 may be such that they follow each junction 32 by approximately the amount of extension of the twist tie 22 desired from the aperture 20 as shown in FIG. 1, for example 2 inches.

Figure 6:
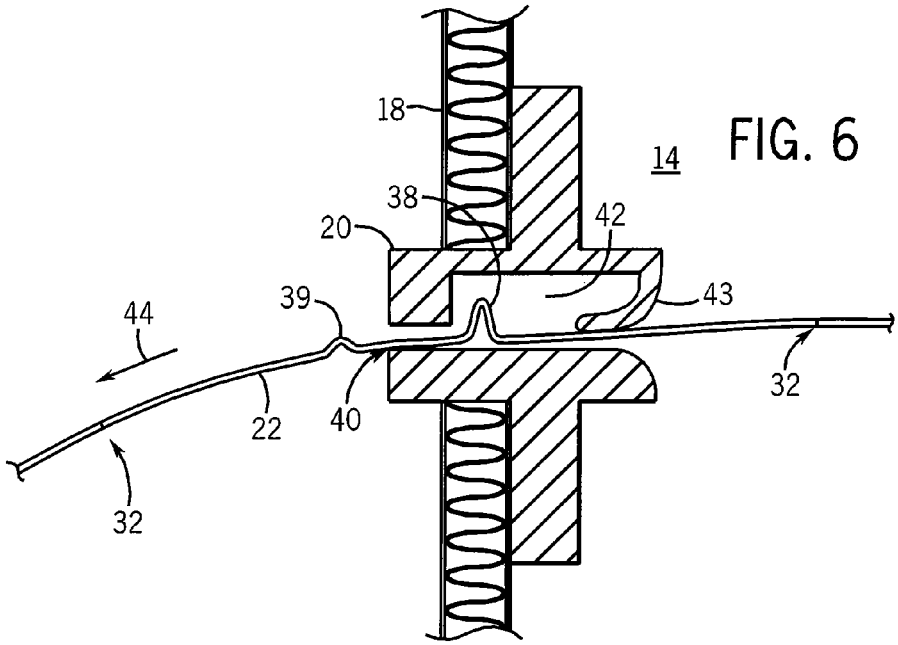
FIG. 6 is a cross-sectional view taken along line 6-6 of FIG. 2 showing catching of the obstruction against a slot of the aperture to cause separation of the ties.

Referring now to FIG. 6, the aperture 20 may provide for a narrow slot 40 allowing free passage of the twist tie 22 therethrough along its length for lengths of the twist tie 22 free from the obstructions 38. The slot 40 may be preceded by a wider slot 42 providing for free passage of the obstructions 38. It will be understood that as the twist tie 22 is pulled from the container 14 as indicated by arrow 44 extending along the length of the twist tie 22, the obstructions 38 will catch at the interface of slots 40 and 42. This catching is sufficient to provide an increase in tension on the exposed portion of the twist tie 22 such as to cause a separation of the twist tie 22 at junction 32 outside of the container 14.

An optional second obstruction 39 may be placed on each twist tie 22 between junctions 32 to prevent the ribbon from recoiling into the container 14 when a twist tie 22 is removed. This second obstruction 39 may pass through the slot 40 by deforming under a tension less than that which would cause separation of twist ties at the junctions 32.

Alternatively or in addition, as shown, the wider slot 42 may be preceded by an inwardly extending cantilevered finger 43 directed downward into the wider slot 42 and toward the slot 40 so as to flex upward to allow the obstruction 38 to pass freely in a direction exiting the container 14 but to prevent retraction of the twist tie 22 into the container by means of the interference between the obstruction 38 and the finger 43. In this way the finger 43 acts like an anti-kickback pawl holding an end of the twist tie 22 outside the container for access by a user after a previous twist tie section is removed and used.

A greater tension applied on the exposed twist tie 22 remaining after removal of the separated twist tie 22, for example by a subsequent user, is sufficient to deform the obstruction 38 sufficiently to allow it to pass through the slot 40 so that this twist tie, too, may be retracted from the container 14 cueing yet another twist tie 22 with its obstruction 38 blocked by the interface between the slots 40 and 42.

It will be appreciated that the slot 34 (shown in FIG. 4) and the obstruction 38 (shown in FIG. 5) may be formed in a single operation by a stamp or roller containing a die for cutting the slot 34 and forming the obstruction 38 and therefore that the ribbon of twist ties 22 may thus be pre-formed using conventional techniques and then passed through a device, for example including die rollers, providing the necessary cutting and forming operations.

The final twist ties in each reel 24 may be colored differently to provide a signal that the reel 24 must be replaced.

While the preferred embodiment describes an attachment of each adjacent twist tie 22 into a single ribbon by preserving portions of the flexible strips at the junctions 32, it will be understood that other acceptable approaches include retaining the flexible strip material 28 fully intact and simply severing the wire 26 or partially severing the wire 26 together with an optional partially severing of the strip material 28, or full severing of the twist ties 22 from each other and reattachment of them together in an end-to-end configuration by an adhesive or other attachment mechanism. It will be further understood that the obstructions may be implemented in an alternative manner, for example, by increasing the width of the strip materials at periodic locations or by applying adhesive dots or the like to a surface of the twist tie to provide the same function.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A twist tie assembly comprising:

a series of at least three twist ties each comprising a ductile wire extending along a length and attached to a flexible strip also extending along the length and on either side of the wire by a distance, wherein the twist ties are releasably attached end-to-end to form a ribbon separable at junctions between ends of the twist ties by a predetermined tension applied across the junction by a user pulling on a twist tie in a dispensing direction, the attachment of the twist tics at the junctions adapted to break before substantial elongation; and a structure supporting the twist ties and providing a slot formed by an aperture through which the twist ties may pass for single twist tie dispensing;

wherein each twist tie further includes an obstruction to catch on the slot sized to freely pass the twist ties along their length in the dispensing direction but for the obstruction;

wherein the obstruction for each twist tie is displaced from a trailing end of the twist tie in the dispensing direction and displaced from the leading ends of the twist tie to provide a free length of twist tie on each twist tie in the dispensing direction; and wherein the obstruction for each twist tie extends perpendicularly to the dispensing direction and is deformable to pass through the slot only after deformation.

2. The twist tie assembly of claim 1 wherein the twist ties are releasably attached end-to-end by continuations of only portions of the flexible strip across the junctions.

3. The twist tie assembly of claim 2 wherein the continuations of portions of the flexible strip are portions at opposed edges of the ribbon perpendicular to the length.

4. The twist tie assembly of claim 1 wherein the wire is at least partially cut at the junctions.

5. The twist tie assembly of claim 1 wherein the wire is fully severed at the junctions.

6. The twist tie assembly of claim 1 wherein the obstruction is a bend formed in the twist tie to provide a hump extending perpendicularly from the length of the twist tie.

7. The twist tie assembly of claim 1 wherein each twist tie provides at least two obstructions in between each pair of junctions, a first obstruction deforming to pass through the slot at a force greater than the predetermined force and a second obstruction deforming to pass through the slot under a force less than the predetermined force.

8. The twist tie assembly of claim 1 wherein the series of twist ties are rolled in a coil to provide center dispensing.

9. The twist tie assembly of claim 1 wherein the flexible strip is selected from the group consisting of paper and plastic.

10. The twist tie assembly of claim 1 further including a box holding the twist ties.

11. The twist tie assembly of claim 1 further including a container and wherein the twist ties are formed into coil positioned within the container and wherein the container includes the aperture providing the slot receiving an end of the coil to pass therethrough; and wherein a catching of the obstruction on the slot provides the predetermined tension.

12. A dispensing system for twist ties comprising:

a coil of a series of twist ties each comprising a ductile wire extending along a length and attached to a flexible strip also extending along the length and on either side of the wire by a distance, wherein the twist ties are releasably attached end-to-end to form a continuous ribbon separable at junctions between ends of the twist tie by a predetermined tension applied across the junction by a user pulling on a twist tie, the attachment of the twist ties at the junctions adapted to break before substantial elongation;

a structure supporting the twist ties and having an aperture providing a slot receiving an end of the coil to pass therethrough;

wherein each twist tie further includes an obstruction to catch on the slot where the slot is sized to freely pass the twist ties along their length but for the obstruction;

wherein a catching of the obstruction on the slot provides the predetermined tension;

wherein the obstruction for each twist tie is displaced from a trailing end of the twist tie in a dispensing directions and displaced from the leading ends of the twist tie to provide a free length of twist tie on each twist tie in the dispensing direction; and wherein the obstruction for each twist tie extends perpendicularly to the dispensing direction and is deformable to pass through the slot only after deformation.

* * * * *